United States Patent [19]

Lan

[11] Patent Number: 4,616,549

[45] Date of Patent: Oct. 14, 1986

[54] MUSIC PLAYING DEVICE

[76] Inventor: Wei-Hsin Lan, No. 45-12, Te Yang Road, Jiau Hsi Country, Yi Lan Hsien, Taiwan

[21] Appl. No.: 742,355

[22] Filed: Jun. 7, 1985

Related U.S. Application Data

[63] Continuation-in-part of Ser. No. 701,484, Feb. 14, 1985.

[51] Int. Cl.[4] ..... G10F 1/06

[52] U.S. Cl. ..... 84/94 R; 200/38 CA; 200/38 BA

[58] Field of Search ..... 84/94 R, 94 C, 95 R, 84/95 C, 97-103, 1.02, 1.03, 1.28, DIG. 12; 200/35 R, 36, 37 R, 38 C, 38 CA, 38 BC, 38 BA

[56] References Cited

U.S. PATENT DOCUMENTS

| | | | |
|---|---|---|---|
| 519,816 | 5/1894 | Langfelder | 84/95 |
| 1,969,147 | 8/1934 | Paul | 84/95 |
| 2,557,061 | 6/1951 | Goldman | 84/97 X |
| 3,309,454 | 7/1964 | Cutler et al. | 84/DIG. 12 X |
| 3,412,197 | 11/1968 | Weitzner | 84/1.28 X |
| 3,476,004 | 11/1969 | Rosen | 84/97 |
| 4,281,575 | 8/1981 | Nakamura | 84/95 R |

FOREIGN PATENT DOCUMENTS

| | | | |
|---|---|---|---|
| 1009463 | 5/1957 | Fed. Rep. of Germany | 84/97 |

*Primary Examiner*—L. T. Hix
*Assistant Examiner*—Brian W. Brown
*Attorney, Agent, or Firm*—Armstrong, Nikaido, Marmelstein & Kubovcik

[57] ABSTRACT

A music playing device, having a music composition member provided with parallel lines and apertures, and pins capable of being selectively and removably inserted in the apertures so as to resemble music notes, and a sound producing unit arranged to be operated by the pins of the music composition member, the sound producing unit being capable of producing sounds of various pitch, so as to produce a melody when operated in association with the music composition member.

8 Claims, 22 Drawing Figures

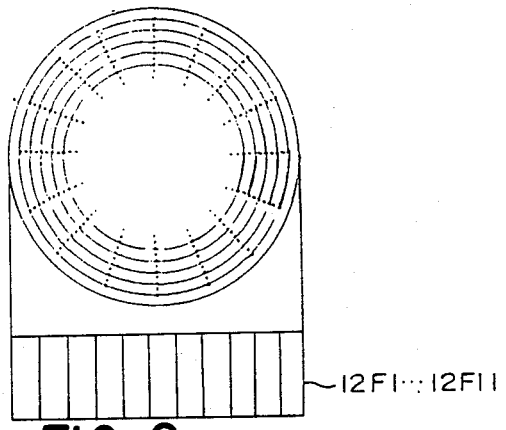
FIG. 8
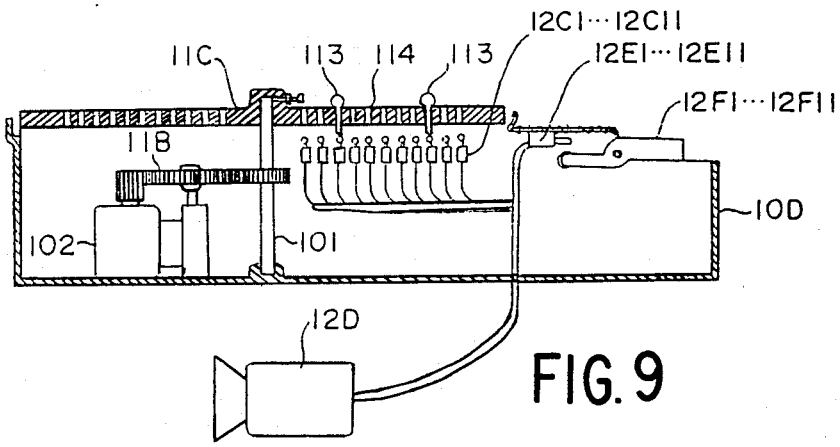
FIG. 9
FIG. 10
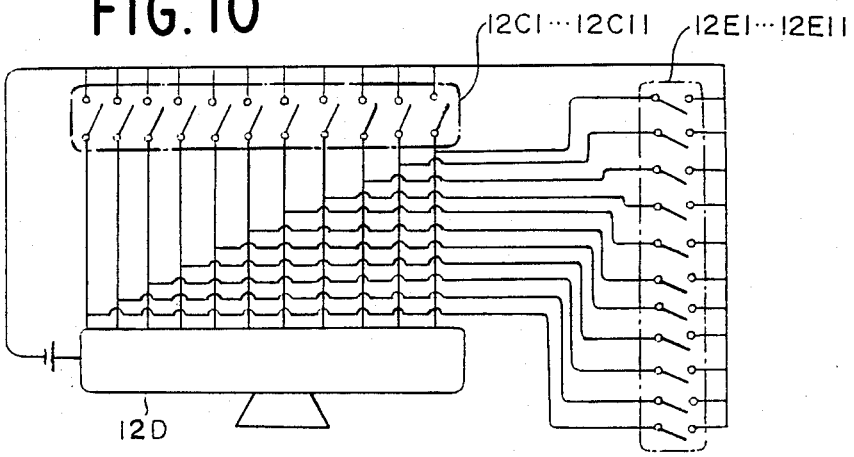

MUSIC PLAYING DEVICE

This application is a continuation-in-part application of my copending application Ser. No. 701,484, filed Feb. 14, 1985.

BACKGROUND OF THE INVENTION

This invention relates to a music playing device wherein a music composition member and a sound producing means are provided in movable relation to each other to produce music when either the music composition member or the sound producing means is moved in relation to the other; the music composition member having a pattern of lines and apertures, and pins that can be selectively arranged in the pattern of lines and apertures to resemble musical notes.

There are a great number of music playing devices, particularly music playing toys, in which a melody is produced by a motorized mechanism. The fun and joy such conventional musical devices provide is very limited as they can normally produce only one melody automatically. Some known devices permit a variety of melodies, such as that disclosed by U.S. Pat. No. 4,281,575, in which a removable rotator having a plurality of fixedly arranged protursions is provided to activate a sound producing means when the rotator is caused to rotate, so as to enable a selection of melodies to be played by the device by replacing the rotator with another having a different arrangement of protrusions. In such known devices, however, the melodies have been previously composed or predetermined. If one wishes to play a melody of one's own composition, the above-mentioned conventional musical devices can not be used.

The present invention therefore offers a musical device having a music composition member to cooperate with a sound producing means to produced a melody that may be composed by the player.

SUMMARY OF THE INVENTION

This invention provides a music playing device, having a music composition member provided with a pattern of lines and apertures, and pins capable of being selectively and removably placed with respect to the pattern of lines and apertures to resemble musical notes, and a sound producing means which is adapted to produce a melody when the music composition member and the sound producing means operate in relation to each other. In a preferred embodiment the music composition member is a cylindrical member and the sound producing means is a row of reeds to be activated by the pins of the music composition member. In another embodiment a disc is employed in place of the cylindrical member, and an electric or electronic sound-producing device is used in place of the row of reeds.

BRIEF DESCRIPTION OF THE DRAWINGS

FIG. 8 is a schematic top view of a seventh embodiment of the music playing device of this invention.

FIG. 9 is a schematic, cross sectional view of the seventh embodiment of this invention as shown in FIG. 8.

FIG. 10 is an electrical circuit diagram of the seventh embodiment of this invention as shown in FIGS. 8 and 9.

DETAILED DESCRIPTION OF THE INVENTION

Figure 1:
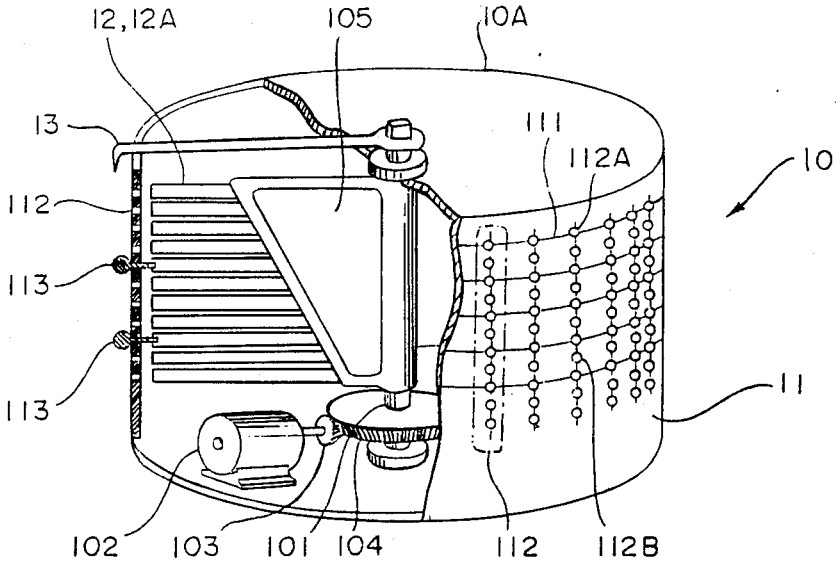
FIG. 1 is a perspective, partially sectional view of a first embodiment of the music playing device of this invention.

As shown in FIG. 1 the music playing device 10 of this invention generally includes a music composition member 11 and a sound producing means 12 to cooperate with the music composition member 11. The music composition member 11 is provided with a plurality of parallel lines 111 to form musical staff and a plurality of rows of apertures 112, with each row of apertures 112 being arranged perpendicular to the musical staff 111, in such a manner that each row of apertures 112 has one aperture 112A on each staff line and one aperture 112B in the space between each two neighboring staff lines. A plurality of pins 113 are selectively and removably inserted into apertures 112 to resemble musical notes, to be further described below.

In the first embodiment as shown in FIG. 1, the music composition member 11 is the cylindrical member of a cylindrical box 10A with the plurality of parallel lines 111 arranged around the circumference of the cylindrical member; the sound producing means 12 is a row of reeds 12A rotatably arranged in the cylindrical box 10A to correspond with parallel lines 111 and the spaces between the lines, so that each line and each space respectively represent the "pitch" of a sound as if the lines represent a musical staff. Music playing device 10 is provided with a central drive shaft 101 on which frame member 105 and the row of reeds 12A are fixedly mounted, and an electric motor 102 for driving shaft 101 through a pair of gears 103, 104. It is to be understood that electric motor 102 may be equipped with a set of reduction gears, not shown, to cause central drive shaft 101 to rotate at an appropriate speed. When drive shaft 101 rotates, the row of reeds 12A rotate with drive shaft 101 at a predetermined speed.

The rows of apertures 112 are equally spaced around the circumference of cylindrical music composition member 11, so that the spacing between each two rows of apertures represents a rhythmic beat. With pins 113 properly inserted into apertures 112, a melody can be composed in the music composition member 11.

Each pin 113 has an inner end protruding inwardly from the music composition member 11 to engage with the corresponding reed of the row of reeds 12A when the row of reeds 12A, or an alternate sound producing means 12, rotates with respect to music composition member 11. Consequently the row of reeds 12A is activated by pins 113 to produce a melody according to the arrangement of pins 113 in the music composition member 11.

Music playing device 10 may also be provided with an indicator 13 fixedly mounted on to the upper end of central drive shaft 101 to rotate synchronously with the row of reeds 12A, so as to enable the player to identify the pins that hit the reeds when the row of reeds rotates.

Figure 2:
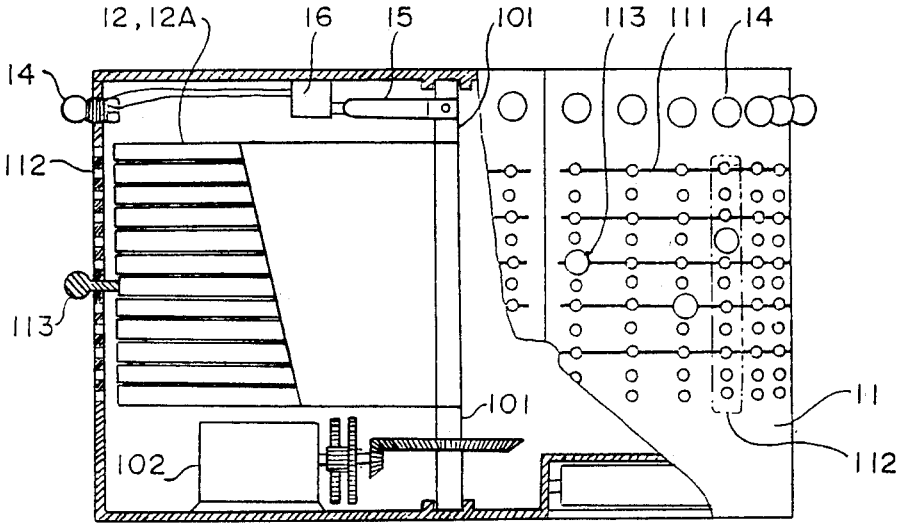
FIG. 2 is a side view of a second embodiment of the music playing device of this invention, with the casing of the device partially cut away.

In the second embodiment of the music playing device as shown in FIG. 2 a lamp 14 is provided at one end of each row of apertures 112 to replace the indicator 13 of FIG. 1. Each lamp 14 is provided with a switch 16 connecting lamp 14 to a power source, not shown, and a cam 15 fixedly mounted on to drive shaft 101 so as to sequentially activate switches 16 as drive shaft 101 rotates; as a result lamp 14 of a row of apertures 112 is lit when the reed or reeds 12A are hit by the pin or pins 113 in that row of apertures. The remaining parts of the second embodiment are the same as the first embodiment.

Figure 3:
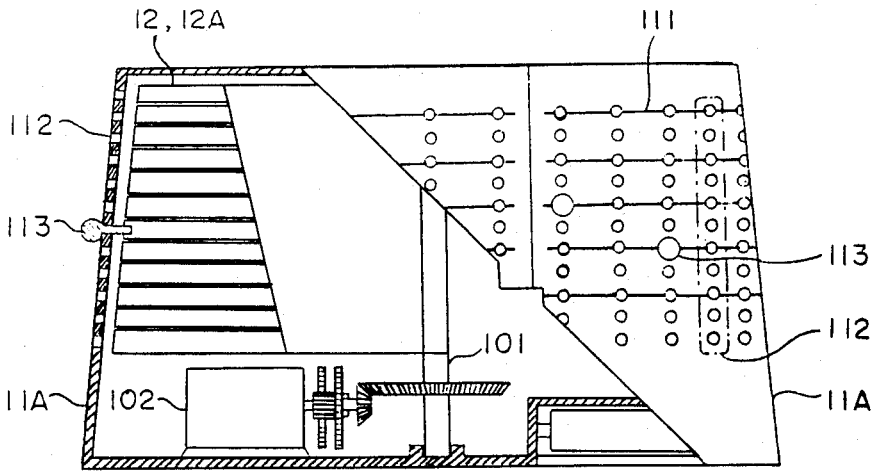
FIG. 3 is a side view of a third embodiment of the musical playing device of this invention, with the casing of the device partially cut away.

FIG. 3 shows a third embodiment of the music playing device of this invention. In this embodiment a truncated, cone-shaped music composition member 11A is employed to facilitate the process of insertion and removal of pins 113. The remaining parts are the same as the first or second embodiment.

Figure 4:
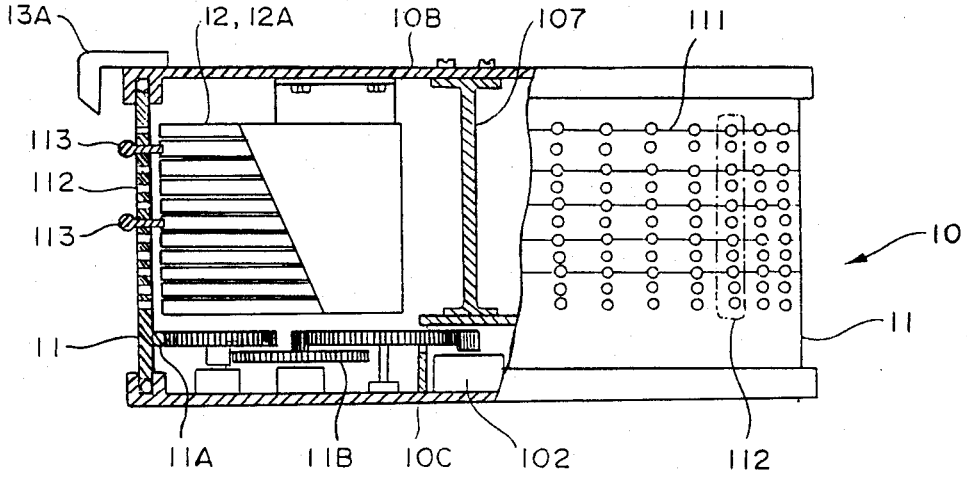
FIG. 4 is a sectional side view of a fourth embodiment of the music playing device of this invention, with the casing of the device partially cut away.

FIG. 4 shows a fourth embodiment of the music playing device of this invention. In this embodiment the device 10 is composed of a circular cover 10B and a circular base 10C fixedly connected to each other by supporting structure 107, a cylindrical music composition member 11 rotatably supported between circular cover 10B and circular base 10C, and a sound producing means 12 which consists of a row of reeds 12A fixedly disposed within device 10. Cylindrical music composition member 11 is provided with an internal ring gear 11A to mesh with a final gear of reduction gear set 11B which transmits the rotary power of electric motor 102 to ring gear 11A. Circular music composition member 11 is provided with a plurality of parallel lines 111 forming a musical staff and rows of apertures 112 in the same arrangement as the first and second embodiments. An indicator 13A is provided on the periphery of circular cover 10B to indicate the position of the row of reeds. When electric motor 102 is energized to rotate, cylindrical music composition member 11 rotates accordingly and causes pins 113 to hit reeds 12A sequentially so as to produce a melody according to the arrangement of pins 113.

Figure 5:
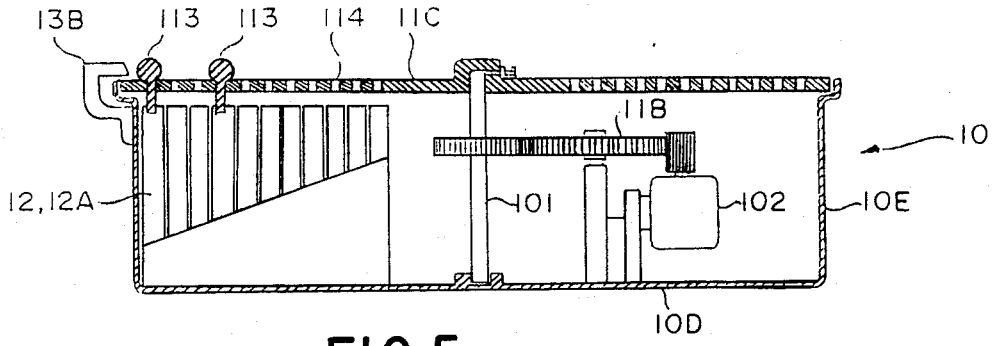
FIG. 5 is a sectional side view of a fifth embodiment of the music playing device of this invention.
Figure 6:
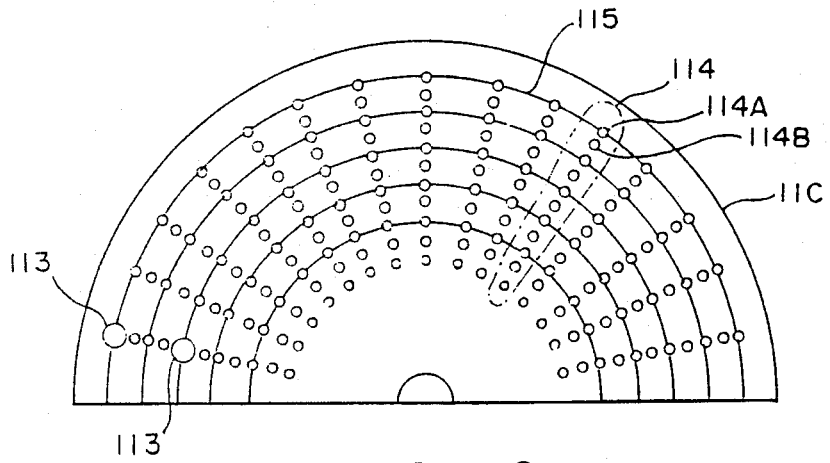
FIG. 6 is a top view of the device of FIG. 5, showing one half of the upper part of the device.

FIGS. 5 and 6 shows a fifth embodiment of the music playing device of this invention. In this embodiment the music playing device 10 comprises a base member 10D having a cylindrical wall 10E, a circular disc shaped music composition member 11C rotatably supported at the upper edge of cylindrical wall 10E of base member 10D, the circular disc shaped music composition member 11C being fixedly mounted on to a central drive shaft 101 driven by electric motor 102 through an intermediate gear 11B, and a sound producing means 12 having a row of reeds 12A fixedly disposed in base member 10D. Circular disc shaped music composition member 11C is provided with a plurality of concentric circular lines 115 represent a musical staff as shown in FIG. 6 and a plurality of rows of apertures 114 radially arranged and equally spaced around 360 degrees. Each row of apertures has one aperture 114A on each circle 115 and one aperture 114B in between each two neighboring circular lines 115. A plurality of pins 113 are selectively and removably inserted into apertures 114 to resemble musical notes as in the case of the first and second embodiments. The rows of reeds 12A is so disposed as to correspond with the circular lines 115 and spacing between the circular lines 115 so that when the circular disc shaped music composition member 11C rotates, pins 113 are caused to hit corresponding reeds 12A to produce a melody according to the arrangement of pins 113. An indicator 13B may be provided on the upper outer, part of the cylindrical wall 10E of base member 10D to indicate the position of the row of reeds 12A.

Figure 7:
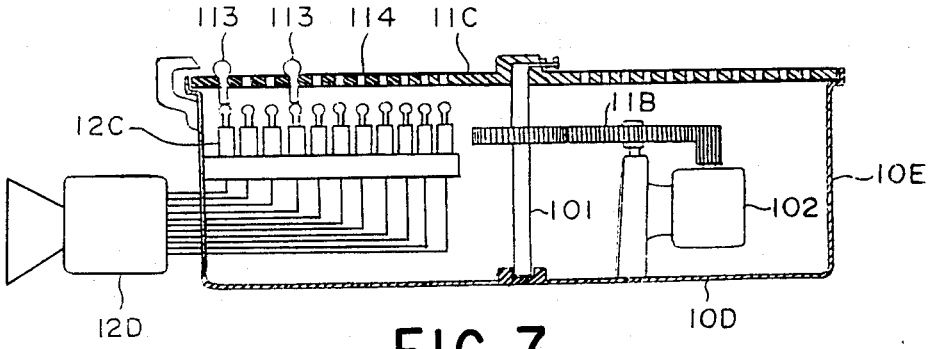
FIG. 7 is a schematic, cross sectional view of a sixth embodiment of the music playing device of this invention.

FIG. 7 shows a sixth embodiment of the music playing device of this invention. In this embodiment the device is provided with a sound producing means that consists of a row of electrical switches 12C and an electric or electronic sound producing unit 12D, and a circular disc shaped music composition member 11C of the same arrangement as that of the fifth embodiment. The row of electrical switches 12C is disposed underneath the circular disc shaped music composition member 11C so that the switches 12C are activated when the circular music composition member 11C rotates to cause pins 113 to hit corresponding switches 12C. Switches 12C are connected to electric or electronic sound producing unit 12D so that when a switch 12C is activated the sound producing unit 12D is activated to produce the sound of the specific pitch represented by the position of the pin 113 that hits the corresponding switch 12C.

FIGS. 8, 9 and 10 show a seventh embodiment of the music playing device of this invention. In addition to the arrangement of the device of the sixth embodiment having a first row of switches, the device of the seventh embodiment comprises a second row of electrical switches 12E1 . . . 12E11 and a row of keys 12F1 . . . 12F11 corresponding to the second row of electrical switches 12E1 . . . 12E11 as shown in FIGS. 9 and 10. The switches 12E1 . . . 12E11 of the second row of switches are respectively connected in parallel with the switches 12C1 . . . 12C11 of the first row of switches which connect an electric or electronic sound producing unit 12D to a power source as shown in FIG. 10. Switches 12E1 . . . 12E11 are operable by respective keys 12F1 12F11 which are pivotally mounted onto base member 10D. This embodiment enables the player to play a second melodic or harmonic line, or to produce a series of rhythmic sounds by operating keys 12F1 . . . 12F11 while the device is in operation.

FIGS. 11, 12, 13 and 14 show an eighth embodiment of the music playing device of this invention. The device of this embodiment is provided with a cylindrical music composition member 11 provided with a plurality of parallel lines 111 forming a musical staff arranged around the circumference of the cylindrical member 11 and a plurality of rows of apertures 112C1 . . . 112C11 as in the case of the first and second embodiments. A sound producing means which includes a motor-driven rotary arm 12R driven by electric motor 102 and gears 103, 104, and an electric or electronic sound producing unit 12D is provided to cooperate with the cylindrical music composition member 11.

Figure 11:
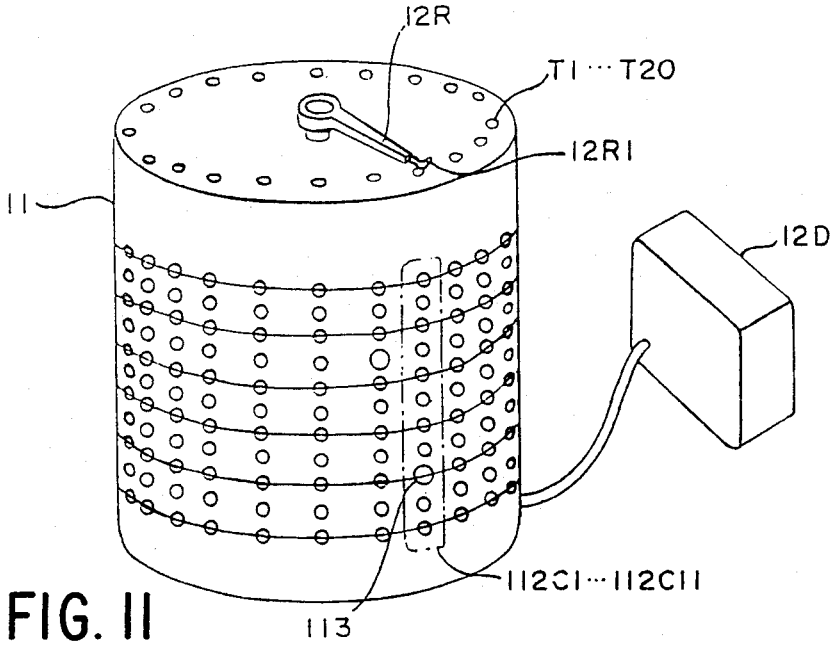
FIG. 11 is an eighth embodiment of the music playing device of this invention.
Figure 12:
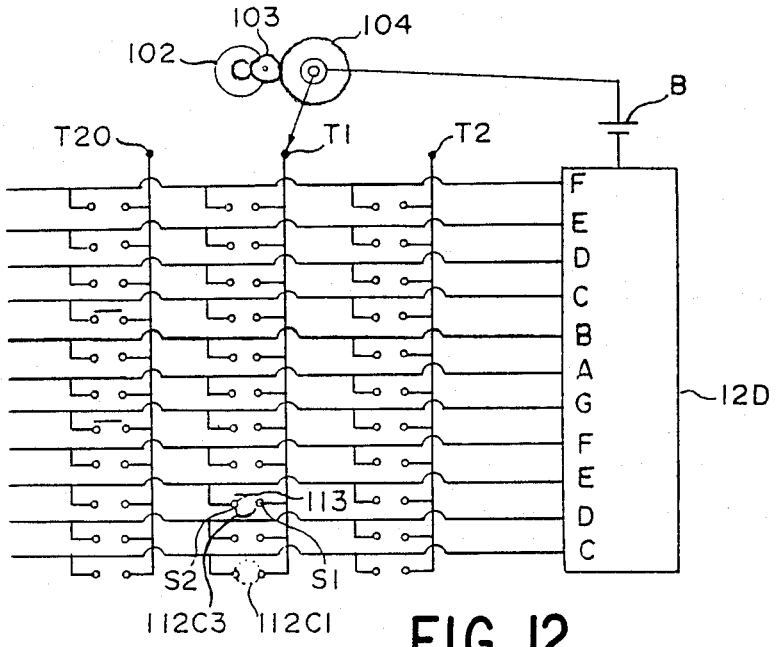
FIG. 12 is an electric circuit diagram of the eighth embodiment of this invention as shown in FIG. 11.
Figure 13:
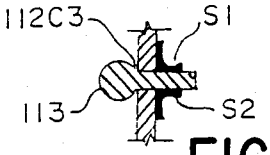
FIG. 13 is a cross sectional view of a pin employed in the device of FIG. 11, showing the pin being inserted in an aperture provided with a pair of contact points.

Each aperture 112C1 . . . or 112C11 is provided with a pair of electrical contact points S1, S2 as shown in FIGS. 12 and 13, and one (S1) of the pair of electrical contact points S1, S2 of each aperture of the same row 112 is connected to a contact terminal T1, so that each row of appeartures 112C1 . . . 112C11 has a respective contact terminal T1, T2 . . . or T20 as shown in FIG. 11. The contact terminals T1, T2 . . . T20 are arranged in a circle so that the rotary arm 12R, having a contact point 12R1, comes in contact with each contact terminal T1, T2 . . . or T20 sequentially when the rotary arm 12R is driven to rotate. The contact point 12R1 of rotary arm 12R is electrically connected to an electrical power source B which supplies electrical power to sound producing unit 12D, as shown in FIG. 12.

The other contact point S2 of each pair of electrical contact points S1, S2 of each aperture is electrically connected to one of the input terminals C, D, . . . F to correspond with the order of the respective apertures in the row of apertures 112C1 . . . 112C11. For example, the second terminal S2 of the first aperture 112C1 of each row of apertures is connected to the first input terminal C as shown in FIG. 12. Each input terminal C, D, or F of electrical or electronic sound producing unit 12D, when electric power is applied, causing the electrical or electronic sound producing unit 12D to produce the sound of designated pitch.

Pins 113 are provided to be selectively and removably inserted into apertures 112C1 . . . 112C11, as in the case of the first and second embodiments, to resemble music notes. Each pin 113 is made on an electrically conductive material so that when a pin 113 is inserted into an aperture 112C3 of the row having contact terminal T1, for example, the pair of contact points S1, S2 of the aperture 112C3 is electrically closed. When rotary arm 12R rotates to come into contact with contact terminal T1 while a pin 113 is inserted into aperture 112C3 of the row having the contact terminal T1, electrical power is applied to input terminal E to cause electrical or electronic sound producing unit 12D to produce a sound corresponding to the pitch represented by aperture 112C3, or "Mi" for example.

Figure 14:
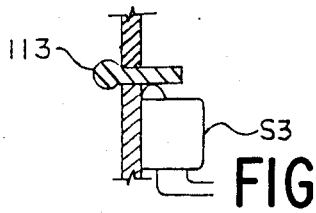
FIG. 14 is a cross sectional view of a pin of the device of FIG. 11, showing the pin being inserted in an aperture provided with an electrical switch.

It is to be understood that the cylindrical music composition member 11 is made of electrically non-conductive material such as a plastic; however, if the pair of contact points S1 and S2 is replaced by a switch device S3 such as a micro-switch to be activated by a pin 113 as shown in FIG. 14, then the pin 113 and cylindrical music composition member 11 may be made of any material.

Figure 15:
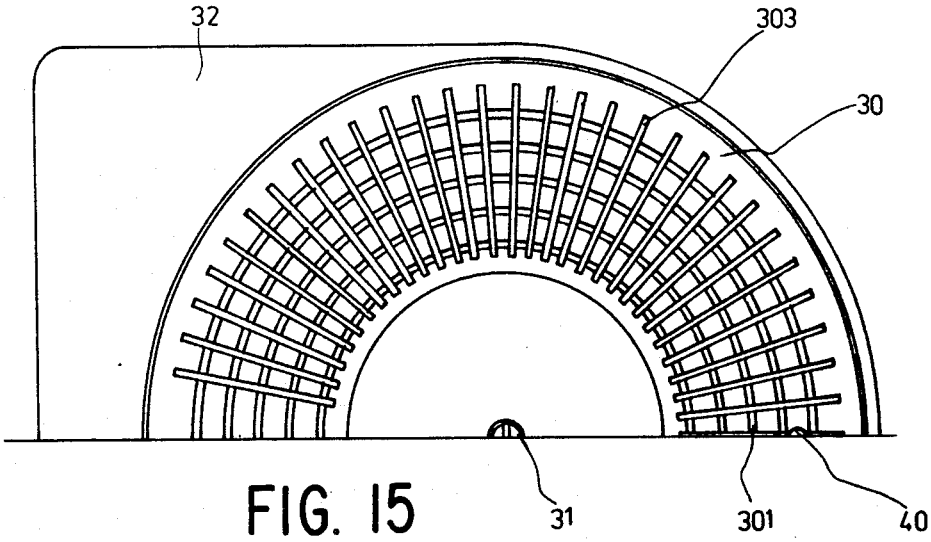
FIG. 15 is a top view of a ninth embodiment of the music playing device of this invention.
Figure 16A:
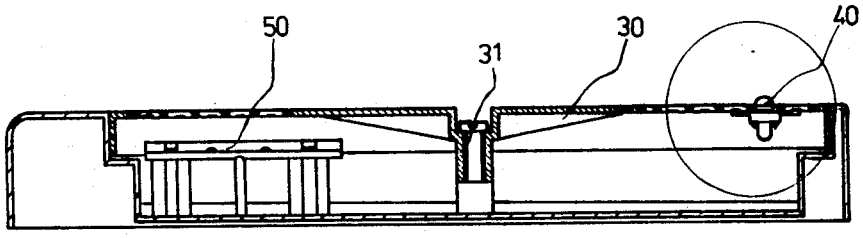
FIG. 16 is a sectional side view of the ninth embodiment of this invention as shown in FIG. 15.
Figure 16B:
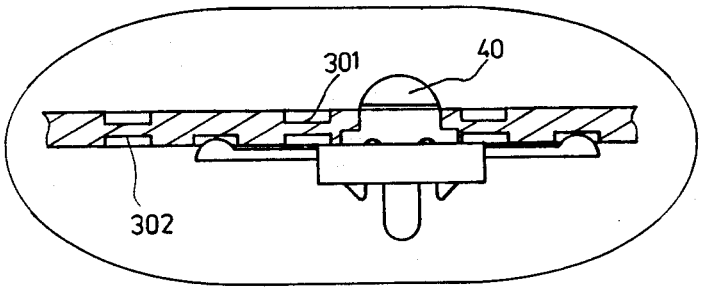

As shown in FIG. 15 and FIG. 16, the disc 30 of one the ninth embodiments is mounted on the casing 32 with a shaft 31. The disc 30 has a musical staff 301 arranged concentrically on the top side and a plurality of line grooves 302 arranged concentrically on the bottom side so that the pin 40 will be in song producing position and the user will sense the positioning from the "ta ta" sound produced when operating. The disc 30 also has a plurality of rows of track slots 303 radially arranged. Each track slots 303 may have one or more pin 40.

Figure 17:
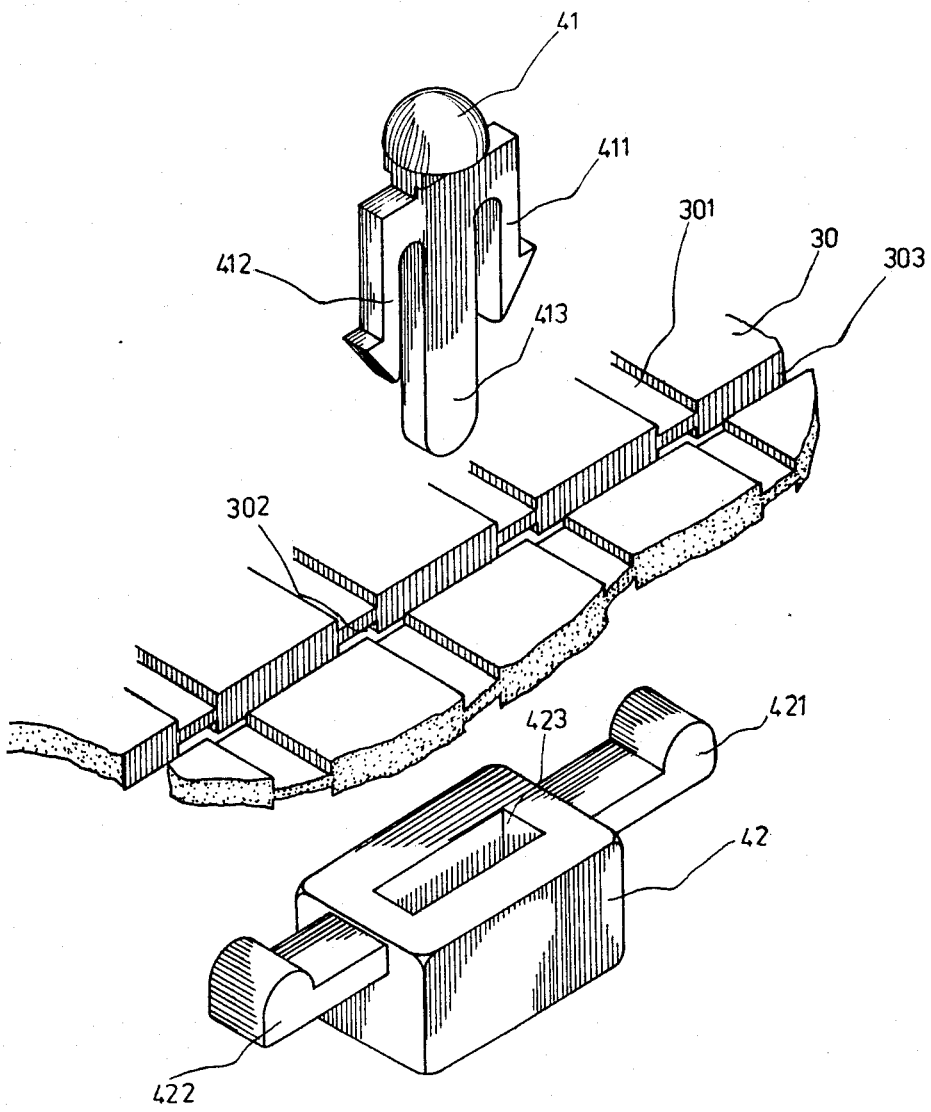
FIG. 17 is a vertical, sectional view of a pin of the ninth embodiment of this invention, as shown in FIG. 15.

As shown in FIG. 17 the pin 40 of this embodiment consists of a pellet 41 having two hooks 411, 412 and a protrudent pin 413, and a positioning strip 42 having two protrudent pellet positioning points 421, 422 at the ends and a retaining slot 423 in the middle. The pellet 41 is on the top side of the disc 30 and the positioning strip 42 is on the bottom side. They can be removably set in the track slots 303 and accurately set in the musical staff 301 and concentric line grooves 302 so that the protrudent pin 413 of the pellet 41 can hit the spring leaves 51 of the spring leaf switches 50 which are connected to a PC board (not shown) 50 to produce sound.

Figure 18:
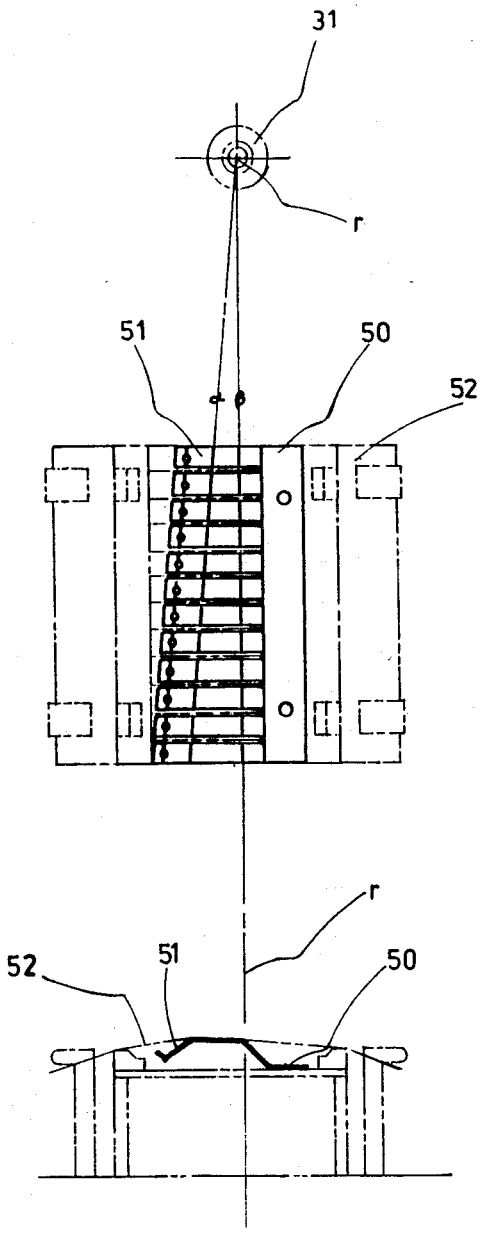
FIG. 18 is a schematic view of a spring switch set of the ninth embodiment of this invention as shown in FIG. 15.

As shown in FIG. 18 the intersection of the lines $\alpha$ and $\beta$ formed by connecting each row of ends of the spring leads 51 of the set of spring leaf switches 50 is at the axis $\gamma$ of the disc shaft 31. The set of spring leaf switches 50 has a paper protective lines 52 made of plastic film so that when the pin 40 on the set of spring leaf switches 50 moves centripetally or centrifugally, it will slide smoothly on the spring leaves 51 without causing damage to them.

Figure 19:
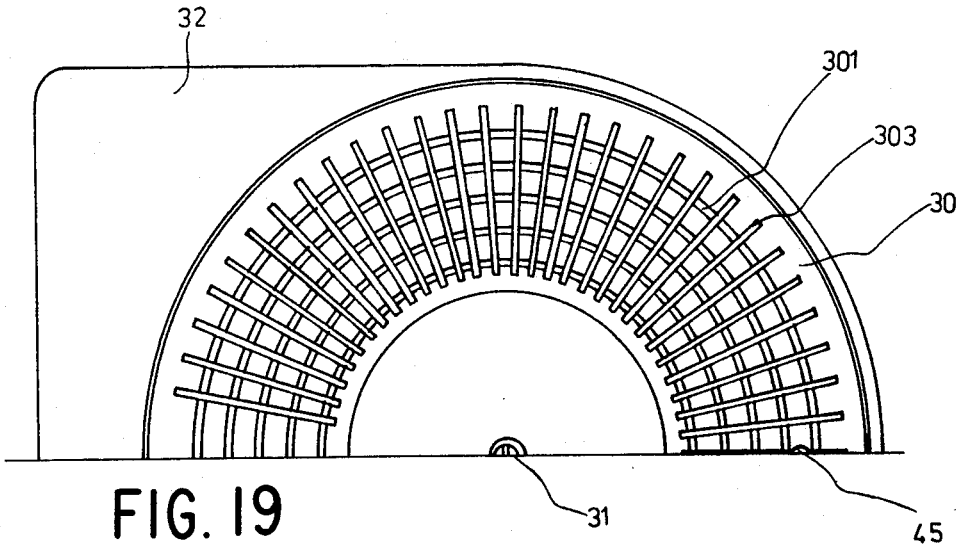
FIG. 19 is a top view of a tenth embodiment of the music playing device of this invention.
Figure 20A:
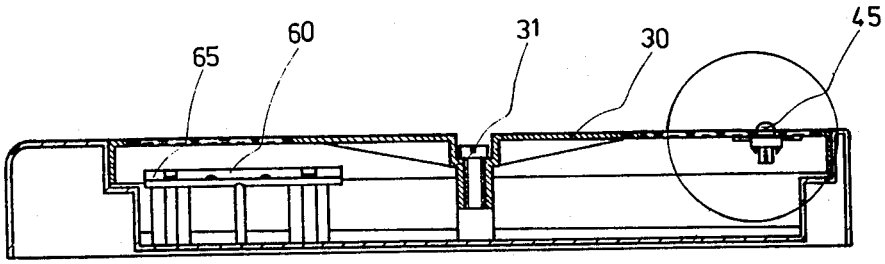
FIG. 20 is a sectional side view of the tenth embodiment of this invention as shown in FIG. 19.
Figure 20B:
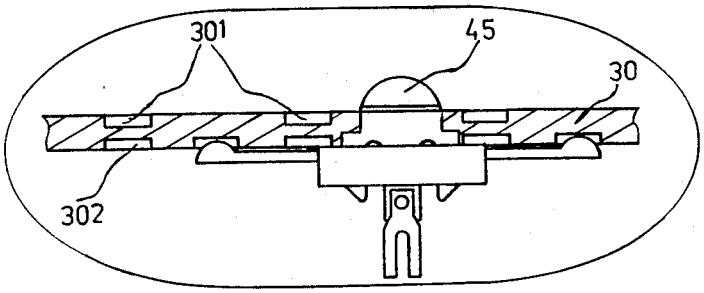

As shown in FIGS. 19 and 20 the tenth embodiment of this invention is similar to the ninth embodiment except the pin 45, the switches 60 and the sound producing PC board 65.

Figure 21:
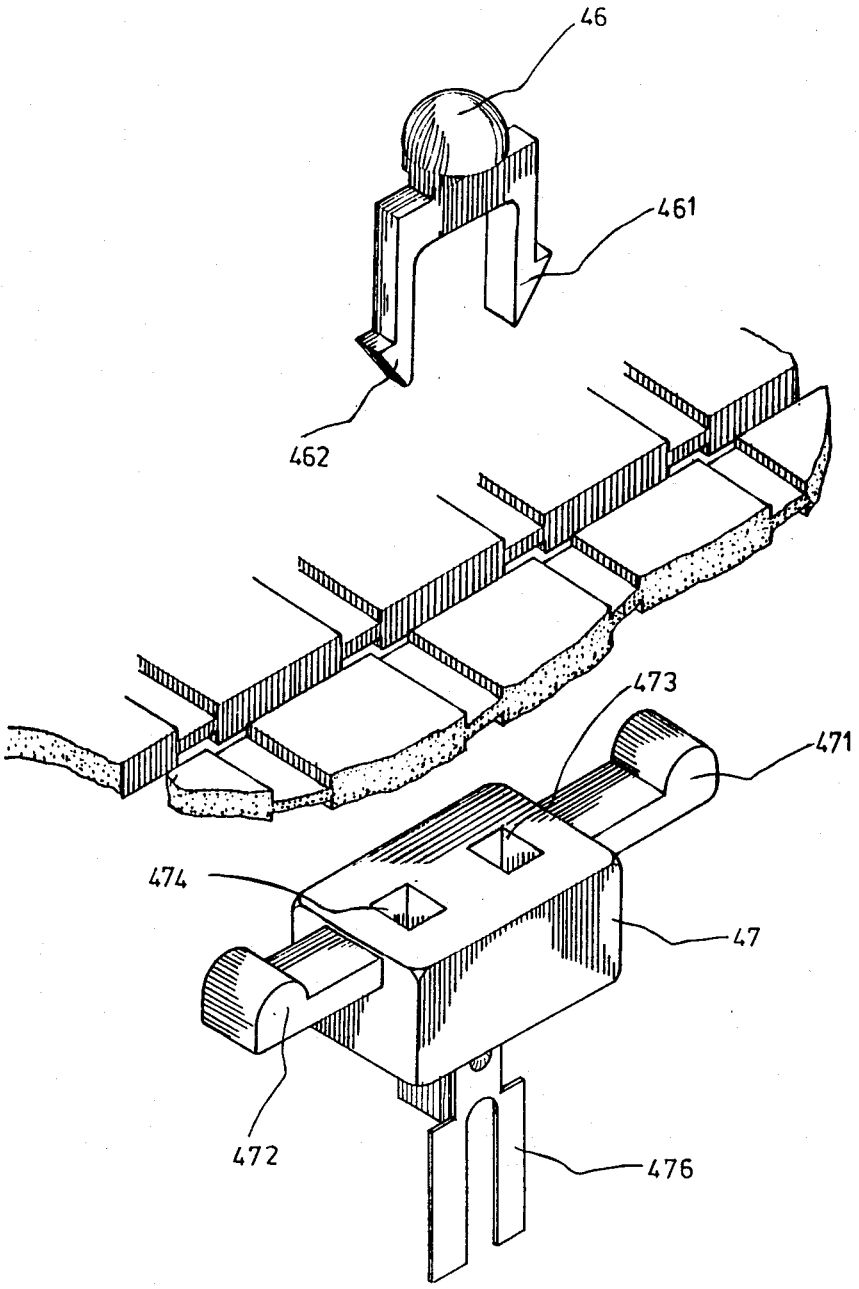
FIG. 21 is a vertical, sectional view of a pin of the tenth embodiment as shown in FIG. 19.

As shown in FIG. 21 the pin 45 of the tenth embodiment also consists of a pellet 46 and a positioning strip 47. The pellet 46 also has two hooks 461, 462 while the strip 47 also has two protrudent pellet positioning points 471, 472 and two retaining slots 473, 474 but has a contact strip 476 in the center which will hit the switches 60 when the disc 30 rotates.

Figure 22:
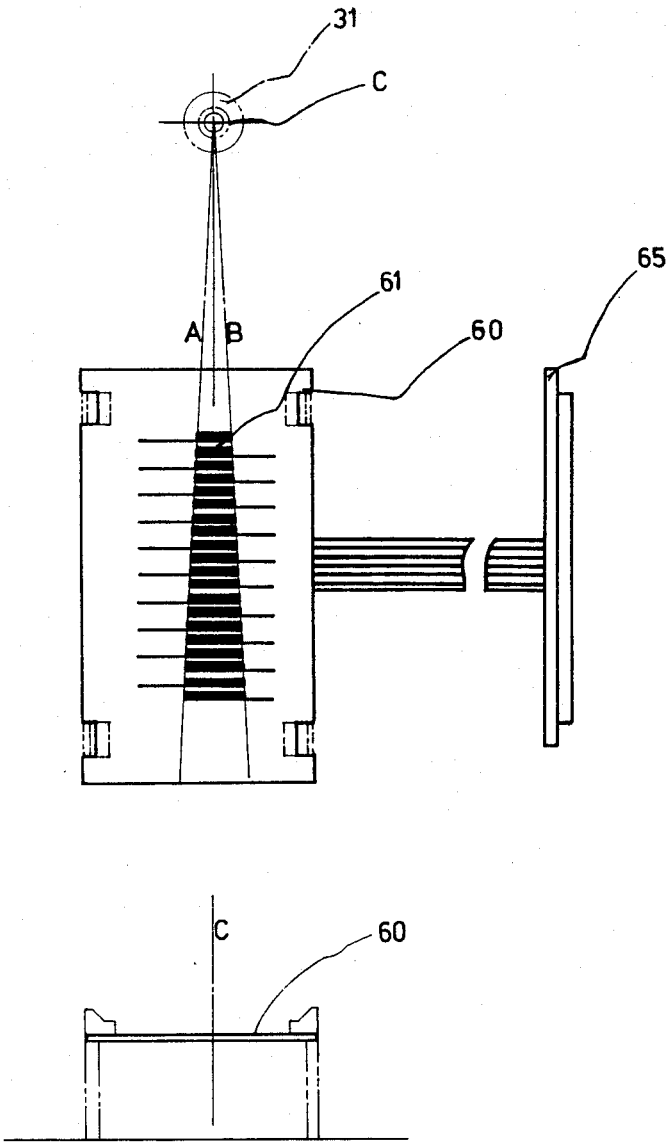
FIG. 22 is a schematic view of a set of switches of the printed circuit of the tenth embodiment as shown in FIG. 19.

The set of switches 60 of the tenth embodiment is shown in FIG. 22. The switches 61 consist of printed circuits and are connected to the corresponding sound producing circuits of the sound producing circuit board 65. The lines A and B formed by connecting each row of ends of the switches 60 also intersect at the axis C of the shaft 31 so that when the disc 30 rotates, the contact strip 476 of the pin 45 will hit each of the switches 61 in equal length of time to produce a melody in equal rythmic beats.

While preferred embodiments of the music playing device have been described and illustrated; it must be understood, however, that the device of this invention can be otherwise modified by persons having ordinary skill in the art without departing from the scope and spirit of the invention as defined in the appended claims.

What is claimed is:

1. A music playing device comprising:

a music composition cylinder member having a plurality of parallel lines arranged circumferentially therearound and a plurality of rows of apertures, each row of apertures being arranged perpendicular to said parallel lines and being generally equally spaced;

a plurality of pins adapted to be selectively and removably inserted into said apertures; and means for producing sounds of various pitch operable in association with said cylindrical member according to the arrangement of said pins in said apertures, said sound producing means comprising:

a pair of first and second electrical contacts arranged in connection with each one of said apertures and being operable to become electrically closed when one of said plurality of pins is inserted into said aperture, a plurality of contact terminals each connecting said first electrical contact of each pair of electrical contacts of one row of said rows of apertures;

a sound producing unit having a plurality of input terminals each being adapted to cause said sound producing unit to produce sound of a selected pitch when electric power is supplied thereto, each said input terminal being electrically connected to said second electrical contact of each pair of electrical contacts positioned along one of said parallel lines;

means for supplying electric power to said sound producing unit;

a rotary arm rotatably arranged with respect to said cylindrical member and capable of coming into contact with said contact terminals in a sequential order when rotated, said rotary arm being electrically connected between said sound producing unit and said means for supplying electric power; and means for rotating said rotary arm.

2. A music playing device comprising:

a base member;

a circular disc rotatably supported on said base member and having an upper surface, a lower surface, and a plurality of first concentric grooves on said upper surface, and a plurality of radial track slots arranged to perpendicularly intersect said first concentric grooves;

a plurality of pins adapted to be selectively and removably inserted into and slidable along said track slots and extend below said bottom surface of said disc;

a sound producing means for producing sounds of various pitch operable in association with said disc according to the arrangement of said pins in said track slots, said sound producing means including spring leaf switches mounted on said base member below said disc along one radial line thereof, and a sound producing circuit connected to said switches such that any pin mounted in one of said track slots along a particular one of said first circular grooves will strike one of said switches and cause said sound producing circuit to produce a sound of a desired pitch.

3. A music playing device as recited in claim 2 wherein each pin consists of a first pellet having two protrudent hooks and a protrudent pin, and a positioning strip having two protrudent second pellets at both ends and a retaining slot in the center, said first pellet is on the top of the disc, and said hooks and said protrudent pin insert in one of the track slots with the hooks retained in the retaining slot of the positioning strip to form said pin which can be slidably set in the track slot.

4. A music playing device as recited in claim 2 wherein the circular disc has second concentric line grooves on the bottom surface so that one of the pins can be accurately set in a sound producing position.

5. A music playing device as recited in claim 2 wherein the set of spring leaf switches has a paper protective cover to prevent the spring leaf switches from being damaged by one of the pins when it is moved along one track slot radially.

6. A music playing device comprising:

a base member;

a circular disc rotatably supported on said base member and having an upper surface, a lower surface, and a plurality of first concentric grooves on said upper surface, and a plurality of radial track slots arranged to perpendicularly intersect said first concentric grooves;

a plurality of pins adapted to be selectively and removably inserted into and slidable along said track slots, each having a contact strip extending below said bottom surface of said disc;

a sound producing means for producing sounds of various pitch operable in association with said disc according to the arrangement of said pins in said track slots, said sound producing means including switches mounted on said base member below said disc along one radial line thereof, and a sound producing circuit connected to said switches such that the contact strip of any pin mounted in one of said track slots along a particular one of said first circular grooves will electrically connect one of said switches and cause said sound producing circuit to produce a sound of a desired pitch.

7. A music playing device as recited in claim 6 wherein each pin consists of a first pellet with two protrudent hooks, and a strip having protrudent second pellets at its ends, a pair of retaining slots, and a contact strip positioning piece in its center, said hooks insert in one of the track slots and are retaied in the pair of retaining slots of the strip to form said pin which can be slidably set in the track slot.

8. A music playing device as recited in claim 6 wherein the switches each have a left and a right end and are arranged in such a way that lines defined by connecting both left and right ends of the switches intersect at a center axis of the disc.

* * * * *